US005305840A

United States Patent [19]

Liang et al.

[11] Patent Number: 5,305,840

[45] Date of Patent: Apr. 26, 1994

[54] ROCK BIT WITH COBALT ALLOY CEMENTED TUNGSTEN CARBIDE INSERTS

[75] Inventors: Dah-Ben Liang; Madapusi K. Keshavan, both of The Woodlands, Tex.

[73] Assignee: Smith International, Inc., Houston, Tex.

[21] Appl. No.: 944,430

[22] Filed: Sep. 14, 1992

[51] Int. Cl.[5] ..... E21B 10/00

[52] U.S. Cl. ..... 175/426; 175/375

[58] Field of Search ..... 175/426, 374, 375, 435, 175/420.1

[56] References Cited

U.S. PATENT DOCUMENTS

| | | | |
|---|---|---|---|
| 4,593,776 | 6/1986 | Salesky et al. | 175/375 |
| 4,630,692 | 12/1986 | Ecer | 175/405.1 |
| 4,907,665 | 3/1990 | Kar et al. | 175/426 |
| 4,961,780 | 10/1990 | Pennington, Jr. | 75/238 |
| 4,963,183 | 10/1990 | Hong | 75/241 |
| 5,110,349 | 5/1992 | Westergren et al. | 75/233 |

OTHER PUBLICATIONS

S. Ekemar, et al., "Nickel As a Binder in WC-Based Cemented Carbides", Paper Presented at the 10th Plansee Seminar, Reutte, Jun. 1981, 4 pages.

W. Precht, et al., "Abrasion Resistance of Cermets Containing Co/Ni Binders" Martin Marietta Laboratories, pp. 815-828.

Nishigaki, et al., Binder Phase Strengthening Through v' Precipitation of "WC-Co-Ni-Cr-Al Hard Alloys", HM #), pp. 487-508.

C. H. Vasel, et al., "Binder Deformation in WC-(-Co,Ni) Cemented Carbide Composites", *Metallurgical Transactions A*—vol. 16A, Dec. 1985, pp. 2309-2317.

Luo Zhonglin, "Improved Carbide Cutting Tools for Machining of Difficult Materials", MPR, Dec. 1987, pp. 846-848.

Masumoto, et al., "Corrosion Resistance of Cemented Carbide", *Nippon Tungsten Review*, vol. 19 (1986) pp. 26-32.

*Primary Examiner*—Thuy M. Bui

*Attorney, Agent, or Firm*—Christie, Parker & Hale

[57] ABSTRACT

A rock bit employs cemented tungsten carbide inserts for engaging a rock formation for drilling oil wells or the like. The cemented tungsten carbide inserts have as a binder phase a cobalt base alloy including from 10 to 35% by weight nickel, from 3 to 10% by weight chromium, from 1 to 6% by weight of molybdenum, and a balance primarily of cobalt. A particularly preferred composition has 6% by weight chromium, 17% by weight nickel, 4% by weight molybdenum and a balance of cobalt. Wear resistance is enhanced without loss of toughness in the inserts.

29 Claims, 1 Drawing Sheet

ROCK BIT WITH COBALT ALLOY CEMENTED TUNGSTEN CARBIDE INSERTS

BACKGROUND OF THE INVENTION

This invention relates to rock bits for drilling oil wells or the like where the cutting action is provided by wear resistant, corrosion resistant tungsten carbide inserts having as a binder phase a cobalt alloy including chromium and nickel.

Oil wells and the like are commonly drilled with rock bits having rotary cones with cemented tungsten carbide inserts. As such a bit is rotated on the bottom of a drill string in a well, the cones rotate and the carbide inserts bear against the rock formation, crushing and chipping the rock for extending the depth of the hole. Typical inserts have a cylindrical body which is pressed into a hole in such a cone and a somewhat blunt converging end that protrudes from the face of the cone. The converging end of the insert may be generally conical, roughly hemispherical, or have a somewhat chisel-like shape.

Another type of bit for drilling rock employs a steel body in which similar tungsten carbide inserts are embedded. Such a rotary percussion bit is hammered against the bottom of the hole for shattering rock and gradually rotated as it drills. Another type of rock bit referred to as a drag bit is simply rotated in the hole with carbide inserts "dragging" across the bottom of the hole for scraping the rock formation. Inserts provided in practice of this invention may be used in either type of rock bit, or in other related devices such as under-reamers.

Since the tungsten carbide inserts are the parts of the rock bit that engage and drill the rock, it is important to minimize wear and breakage of such inserts. Tungsten carbide inserts for rock bits are made by sintering a mixture of tungsten carbide (WC) powder and cobalt to form a dense body with very little porosity. Two important properties of such inserts are wear resistance and toughness. It is desirable to enhance the hardness of an insert where it engages the rock formation and maintain toughness for minimizing breakage of the insert as it is used.

It has been found that an element of wear resistance of rock bit inserts includes resistance to corrosion. Rock bits are commonly used in an environment of drilling mud which may include corrosion inhibitors. However, even so, the drilling mud may have changed pH and chemical composition, such as high amounts of chlorides, which may corrode the inserts as well as the steel of the rock bit. The cobalt binder phase in the cemented tungsten carbide inserts may be leached in either basic or acidic drilling mud, and the cobalt is particularly susceptible to corrosion by chloride containing compositions. It is therefore desirable to enhance the corrosion resistance of the cemented tungsten carbide inserts of a rock bit.

In rock bits designed for a particular type of service, one needs to have an appropriate balance between hardness and toughness. Hard inserts resist wear during drilling. On the other hand, a hard insert may be susceptible to fracture under the impact loads and other abuses necessarily involved in drilling wells. Enhanced toughness is also advantageous, since the part of the insert extending beyond the face of the cone does not need to be as blunt to resist fracture. This means that a longer, more aggressive cutting structure can be employed on a rock bit where fracture toughness is adequate.

In essentially all bits, it is desirable to have high hardness and wear resistance and relatively large insert protrusion. Achievement of these desiderata may, however, be limited by a lack of fracture toughness in the main body of the insert. Thus, it is desirable to have a hard and tough insert with good corrosion resistance.

BRIEF SUMMARY OF THE INVENTION

There is, therefore, provided in practice of this invention, according to a presently preferred embodiment, a rock bit body for connection to a drill string for drilling rock formation, with a plurality of cutter inserts mounted adjacent to the downhole end of the bit for engaging a rock formation. At least a portion of the inserts comprise cemented tungsten carbide having as a binder phase a cobalt base alloy having from 10 to 35% by weight nickel, and preferably from 1 to 10% by weight of at least one additional alloying element selected from the group consisting of titanium, zirconium, hafnium, vanadium, niobium, tantalum, chromium, molybdenum and tungsten, and a balance primarily of cobalt. Preferably, the binder phase has from 15 to 20% nickel, from 3 to 10% chromium, and from 1 to 6% molybdenum.

BRIEF DESCRIPTION OF THE DRAWINGS

These and other features and advantages of the present invention will be appreciated as the same becomes better understood by reference to the following detailed description when considered in connection with the accompanying drawings, wherein.

DETAILED DESCRIPTION

Figure 1:
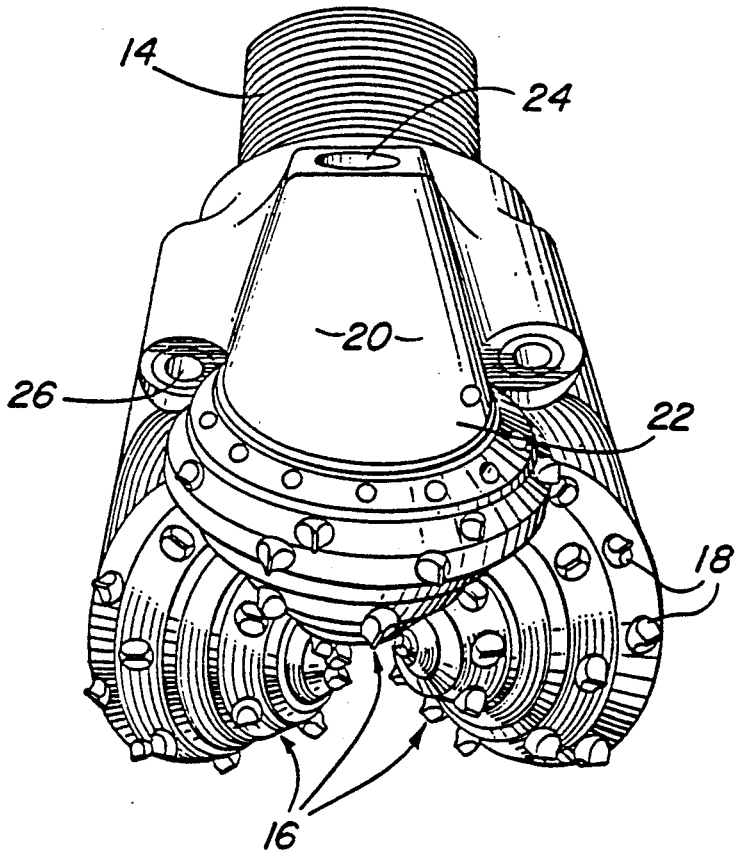
FIG. 1 illustrates a typical, conventional rock bit in which inserts made in practice of this invention are employed.
Figure 2:
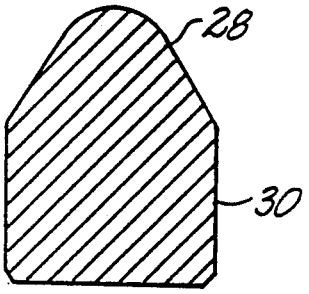
FIG. 2 illustrates an exemplary insert in longitudinal cross section.

Oil and gas wells and the like are commonly drilled with so-called three cone rock bits. Such a rock bit has a steel body 20 with threads 14 at its upper "pin" end and three depending legs 22 at its lower or downhole end. Three steel cutter cones 16 are rotatably mounted on the three legs at the lower end of the bit body. A plurality of cemented tungsten carbide inserts 18 are press-fitted into holes in the surfaces of the cones. Lubricant is provided to the journals on which the cones are mounted from each of three grease reservoirs 24 in the body.

When the rock bit is used, it is threaded onto the lower end of a drill string and lowered into a well. The bit is rotated with the carbide inserts in the cones engaging the bottom of the hole. As the bit rotates, the cones rotate on the body, and essentially roll around the bottom of the hole. The weight on the bit is applied to the rock formation by the carbide inserts and the rock is thereby crushed and chipped by the inserts. A drilling mud is pumped down the drill string to the bottom of the hole and ejected from the bit body through nozzles 26. The mud then travels up the annulus between the drill string and the hole wall. The drilling mud provides cooling and removes chips from the bore hole.

Improved inserts provided in practice of this invention may be made by conventional techniques. Thus, a mixture of tungsten carbide powder and metal binder powder is milled with a temporary wax binder. The mixture is pressed to form a "green" compact having the same shape as the completed insert. This shape is in the form of a cylinder 28 with a converging end portion 30 at one end of the cylinder. The converging portion may have any of a number of conventional configurations, including a chisel-like end, a hemispherical end, or a rounded conical end.

The green compacts are loaded into a high temperature vacuum furnace and gradually heated until the temporary binder wax has been vaporized. The temperature is then elevated to about the melting temperature of the binder phase, whereby the compact is sintered to form an insert of high density, that is, without substantial porosity. The inserts are then relatively slowly cooled in the vacuum furnace. After tumbling, inspection and grinding of the cylindrical body, such inserts are ready for use in rock bits.

Conventional inserts for rock bits have been made with various particle sizes of tungsten carbide and a binder phase of cobalt. Proposals have been made for use of iron or nickel as the binder phase, but these have apparently not proved satisfactory since iron and nickel binders are not used in commercially available rock bit inserts. An improved insert provided in practice of this invention has a binder phase made with a cobalt alloy containing chromium for corrosion resistance and nickel in sufficient quantity to inhibit phase transformation of the alloy.

At higher temperatures a cobalt-chromium alloy has a more ductile face centered cubic crystal structure and at lower temperatures a less ductile hexagonal close packed $\epsilon$ structure and/or a brittle tetragonal $\sigma$ or $\gamma$ structure. Nickel is employed in the alloy used for a rock bit insert binder phase for retaining the tougher, more ductile face centered cubic crystal structure to lower temperatures. The materials of such a composition retain adequate transverse rupture strength for making wear resistant cemented tungsten carbide inserts. The nickel and chromium in the alloy also provide corrosion resistance. A preferred alloy composition has about two orders of magnitude greater resistance to corrosion than the usual cobalt binder.

In addition to chromium and nickel the binder phase may also include molybdenum and tungsten. Molybdenum is included for increased strength and toughness. Tungsten may be included for carbon control for maintaining stoichiometry of the tungsten carbide particles. For similar reasons the binder phase also includes some dissolved carbon. For such reasons some of the chromium may be present in the completed insert as chromium carbide and, in fact, when formulating the original binder phase some of the chromium may be included as very finely divided chromium carbide.

The various ingredients of the binder phase are preferably preformulated as a powdered alloy to assure a homogeneous distribution. Alternatively, very finely divided metal powders of each of the ingredients or subsets of the ingredients may be commingled and distributed uniformly through the mixture with tungsten carbide particles by vigorous ball milling or mixing in an attritor or the like. For example, the binder composition may be made by mixing a nickel-cobalt alloy powder with chromium or chromium carbide powder and molybdenum powder. Other combinations for formulating the binder composition will be apparent.

The amount of chromium in the cobalt-base binder phase is in the range of from 3 to 10% by weight. If the amount of chromium is less than about 3% the resistance to corrosion is significantly decreased. Preferably the chromium content is in the range of from 6 to 8% for optimum combination of corrosion resistance and toughness. The corrosion resistance is decreased about an order of magnitude when decreased to 3%. If the chromium content is more than about 10% by weight, there is a decrease in toughness and there is difficulty in carbon control. It is important in a cemented tungsten carbide product to control the stoichiometry of the tungsten carbide so as to avoid an excess of carbon or tungsten. A high proportion of chromium tends to react with the carbon to form chromium carbide and upset the stoichiometry of the tungsten carbide. Furthermore, it appears that increasing the chromium content above about 10% may cause porosity in the sintered insert.

The nickel content should be in the range of from 10 to 35% by weight and is preferably in the range of from 15 to 20%. When the nickel content is less than 10% the corrosion resistance is largely unchanged as compared with a cobalt binder phase. When the nickel content is more than 35% by weight, the toughness of the insert tends to decrease. A range of nickel content from 15 to 20% is preferred to provide the best wear resistance without loss of toughness.

The ratio of cobalt to nickel concentration is preferably in the range of from 3:1 to 6:1 with higher proportions being particularly preferred.

Molybdenum may be present in the range of from 1 to 6% by weight and preferably is present in the range of from 2 to 4% by weight. Below 1% the molybdenum has little, if any, effect. Toughness of the insert decreases below about 2% by weight molybdenum. If the molybdenum content is more than 6% by weight, carbon control becomes extremely difficult and a resultant composite insert has porosity. Preferably the molybdenum content is up to about 4% for avoiding the problems of carbon control and porosity. It is preferred to have at least 2% molybdenum in the composition to enhance toughness.

A particularly preferred composition has 6% by weight chromium, 17% by weight nickel, 4% by weight molybdenum and a balance of 73% of cobalt with usual impurities.

A small amount of tungsten may also be included in the composition for carbon control. If there is excess carbon, a small amount of tungsten can be used to combine with the excess carbon for maintaining the stoichiometry of the tungsten carbide. On the other hand, if there is a deficiency of carbon it may be provided by adding graphite.

The amount of tungsten that can be added is limited so that eta-phase is not formed. The eta-phase is stoichiometrically $CoW_6C$. The amount of tungsten that can be included varies depending on the proportions of tungsten carbide, cobalt and excess carbon in the composite. Increased proportions of carbon and cobalt permit addition of more tungsten without forming eta-phase. Roughly, up to about four percent tungsten would normally be acceptable.

An important alloying ingredient in the cobalt base binder phase is nickel. Other alloying elements may be included with the nickel, including elements from groups IVa, Va and VIa of the periodic table such as titanium, zirconium, hafnium, vanadium, niobium, tantalum, chromium, molybdenum and tungsten, the latter three being preferred. For example, up to 5% niobium may be included. Some of the additional alloying elements may also be present from the tungsten carbide phase. Grain growth inhibitors such as tantalum carbide, titanium carbide and vanadium carbide in the range of from 1 to 2% may be present. Such materials can increase wear resistance at elevated temperatures. Tungsten from the carbide phase is commonly present in the binder phase.

An excess of some elements, such as molybdenum, which are strong carbide formers is to be avoided. The binder phase should retain ductility to provide toughness, and excess carbide formation in the binder phase can be detrimental.

The proportion of binder relative to the tungsten carbide phase is in the same order of magnitude conventionally used with cobalt binder phase. Thus, for rock bit inserts the binder is typically in the range of from 6 to 16% by weight. The nominal particle size of the tungsten carbide is also in conventional ranges, namely from about 1 to 10 micrometers. As is well known, various grades of cemented tungsten carbide with various particle sizes and binder contents can be tailored for applications requiring greater or lesser toughness and greater or lesser hardness.

The sintering temperature of inserts having a cobalt base alloy remains in the same range as conventional processing of inserts with a cobalt binder phase, namely from about 1380° to 1425° C.

Wear resistance of the inserts with the cobalt base alloy binder is noticeably better than inserts with a cobalt binder. For a given hardness, e.g., 86 HRA the wear resistance as measured by ASTM test B611 is about 1.2 wear numbers greater for an insert with the alloy binder as compared with an insert with a cobalt binder. Such enhanced wear resistance is achieved without sacrificing transverse rupture strength. Corrosion resistance of the alloy binder is also at least an order of magnitude improved as compared with a cobalt binder.

Although described in the context of a rotary cone rock bit, it will be apparent that other types of rock bits such as drag bits or rotary percussion bits may also employ inserts with cobalt base alloy binder phase in cemented tungsten carbide inserts. It will also be apparent that minor amounts of other alloy elements may be included in the composition, such as, for example, iron, without departing from the spirit of this invention. Thus, it is to be understood that within the scope of the appended claims this invention may be practiced otherwise than as specifically described.

What is claimed is:

1. A rock bit comprising:

a body having a pin end for connection to a drill string and a downhole end; and a plurality of cutter inserts mounted adjacent to the downhole end of the rock bit for engaging a rock formation, at least a portion of the inserts comprising cemented tungsten carbide having as a binder phase a cobalt base alloy including from 10 to 35% by weight nickel, from 3 to 10% by weight chromium and a balance primarily of cobalt.

2. A rock bit as recited in claim 1 wherein the binder phase also includes from 1 to 6% of molybdenum.

3. A rock bit as recited in claim 2 wherein the nickel content is in the range of from 15 to 20% by weight.

4. A rock bit as recited in claim 3 wherein the chromium content is in the range of from 6 to 8% by weight.

5. A rock bit as recited in claim 1 wherein the nickel content is in the range of from 15 to 20% by weight.

6. A rock bit as recited in claim 6 wherein the chromium content is in the range of from 6 to 8% by weight.

7. A rock bit as recited in claim 1 wherein the chromium content is in the range of from 6 to 8% by weight.

8. A rock bit as recited in claim 1 wherein the binder phase comprises 17% nickel, 6% chromium, 4% molybdenum and a balance primarily of cobalt.

9. A rock bit comprising:

a body having a pin end for connection to a drill string and a downhole end; and a plurality of cutter inserts mounted adjacent to the downhole end of the rock bit for engaging a rock formation, at least a portion of the inserts comprising cemented tungsten carbide having as a binder phase a cobalt base alloy including alloying metals in the range of from 15 to 45% by weight selected from the group consisting of nickel, chromium, molybdenum and tungsten.

10. A rock bit as recited in claim 9 wherein the alloying metals comprise both nickel and chromium.

11. A rock bit as recited in claim 10 wherein the ratio of cobalt to nickel is in the range of from 3:1 to 6:1.

12. A rock bit as recited in claim 9 wherein the chromium content is in the range of from 3 to 10% by weight.

13. A rock bit as recited in claim 9 wherein the chromium content is in the range of from 6 to 8% by weight.

14. A rock bit as recited in claim 9 wherein the nickel content is in the range of from 9 to 35% by weight.

15. A rock bit as recited in claim 9 wherein the nickel content is in the range of from 15 to 20% by weight.

16. A rock bit as recited in claim 9 wherein the binder phase also includes from 1 to 6% of molybdenum.

17. A rock bit as recited in claim 16 wherein the molybdenum content is in the range of from 2 to 4% by weight.

18. A rock bit comprising:

a body having a pin end for connection to a drill string and a downhole end; and a plurality of cutter inserts mounted adjacent to the downhole end of the rock bit for engaging a rock formation, at least a portion of the inserts comprising cemented tungsten carbide having as a binder phase a cobalt base alloy including from 10 to 35% by weight nickel, from 1 to 10% by weight of at least one additional alloying element selected from the group consisting of titanium, zirconium, hafnium, vanadium, niobium, tantalum, chromium, molybdenum and tungsten, and a balance primarily of cobalt.

19. A rock bit as recited in claim 18 wherein the additional alloying element is selected from the group consisting of chromium, molybdenum and tungsten.

20. A rock bit as recited in claim 18 wherein the binder phase includes nickel in the range of from 10 to 35% by weight.

21. A rock bit as recited in claim 20 wherein the nickel content is in the range of from 15 to 20% by weight.

22. A rock bit as recited in claim 20 wherein the binder phase includes chromium in the range of from 3 to 10% by weight.

23. A rock bit as recited in claim 22 wherein the binder phase also includes from 1 to 6% of molybdenum.

24. A rock bit as recited in claim 18 wherein the binder phase includes chromium in the range of from 3 to 10% by weight.

25. A rock bit as recited in claim 24 wherein the chromium content is in the range of from 6 to 8% by weight.

26. A rock bit as recited in claim 24 wherein the binder phase also includes from 1 to 6% of molybdenum.

27. A rock bit comprising:

a body having a pin end for connection to a drill string and a downhole end; and a plurality of cutter inserts mounted adjacent to the downhole end of the rock bit for engaging a rock formation, at least a portion of the inserts comprising cemented tungsten carbide having as a binder phase a cobalt base alloy including from 3 to 10% by weight chromium and sufficient nickel for inhibiting transformation from a face centered cubic crystal structure.

28. A rock bit as recited in claim 27 wherein the nickel content is in the range of from 15 to 20% by weight.

29. A rock bit as recited in claim 27 wherein the binder phase also includes from 2 to 5% of molybdenum.

* * * * *